US007661383B2

(12) United States Patent
Song

(10) Patent No.: US 7,661,383 B2
(45) Date of Patent: Feb. 16, 2010

(54) CONTACT LENS CASE WITH DATE STORING FEATURE

(76) Inventor: Brandon Song, 12525 Queensgate Rd., Midlothian, VA (US) 23114

( * ) Notice: Subject to any disclaimer, the term of this patent is extended or adjusted under 35 U.S.C. 154(b) by 80 days.

(21) Appl. No.: 11/863,713

(22) Filed: Sep. 28, 2007

(65) Prior Publication Data

US 2009/0084305 A1 Apr. 2, 2009

(51) Int. Cl.
*A45C 11/04* (2006.01)
*G09F 11/04* (2006.01)

(52) U.S. Cl. ..... 116/308; 116/312; 206/5.1; 206/459.1

(58) Field of Classification Search ..... 116/307, 116/308, 309, 311, 312, 313, 314, 316, 317, 116/318; 40/113, 114, 115, 495, 496; 206/5.1, 206/459.1; 235/116
See application file for complete search history.

(56) References Cited

U.S. PATENT DOCUMENTS

| | | | | | |
|---|---|---|---|---|---|
| 1,755,696 | A * | 4/1930 | Kluge et al. | ..... | 40/115 |
| 2,106,466 | A * | 1/1938 | Paul | ..... | 235/142 |
| 2,774,158 | A * | 12/1956 | Tamoschat | ..... | 40/307 |
| 4,041,628 | A * | 8/1977 | Sasson | ..... | 40/111 |
| 4,756,423 | A * | 7/1988 | Holtsch | ..... | 206/534 |
| 4,985,879 | A * | 1/1991 | Owens | ..... | 368/89 |
| 5,280,834 | A | 1/1994 | Berkley | | |
| 5,356,012 | A * | 10/1994 | Tang et al. | ..... | 206/534 |
| 5,433,324 | A * | 7/1995 | Leonard | ..... | 206/534 |
| 5,452,792 | A | 9/1995 | Zautke et al. | | |
| 5,984,122 | A * | 11/1999 | Barker et al. | ..... | 215/230 |
| 6,038,997 | A | 3/2000 | Madden | | |
| 6,382,409 | B1 | 5/2002 | Scala | | |
| 6,912,968 | B2 * | 7/2005 | Carbajal | ..... | 116/308 |
| D512,565 | S | 12/2005 | Sasso | | |
| 2005/0258053 | A1 | 11/2005 | Sieg | | |
| 2006/0180566 | A1 * | 8/2006 | Mataya | ..... | 215/230 |

FOREIGN PATENT DOCUMENTS

JP 2003066840 A * 3/2003

* cited by examiner

*Primary Examiner*—R. A. Smith
(74) *Attorney, Agent, or Firm*—QuickPatents, Inc.; Kevin Prince

(57) ABSTRACT

A date indicator for use with a contact lens case having a base and at least one lens container is disclosed. The indicator comprises a lid to selectively close the at least one contact lens container. A generally annular day wheel has a plurality of day indicators on an upper surface thereof, and is rotatably captured within a cylindrical depression of the lid. A generally circular month wheel includes a plurality of mouth indicators on an upper surface thereof, and is rotatably captured on a central spindle of the lid. A torsion spring is fixed to a spring mounting mechanism of the day wheel. One end of the spring engages a sawtooth-notched wall of the month wheel and the other end of the spring engages a sawtooth-notched wall of the lid. The spring allows the day and month wheels to rotate in one direction together while preventing the day wheel from rotating in the opposite direction. The day wheel may be set at a desired day indicator by rotating the month wheel and day wheel together in the one direction. The month wheel may be set at a desired month indicator by rotating the month wheel in the opposite direction.

16 Claims, 3 Drawing Sheets

CONTACT LENS CASE WITH DATE STORING FEATURE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to contact lens cases, and more particularly to a date indicator for use with a contact lens case.

DISCUSSION OF RELATED ART

Numerous innovations for contact lens case timers have been provided in the prior art that will be described. Even though these innovations may be suitable for the specific individual purposes to which they address, however, they differ from the present invention.

A first example, U.S. Pat. No. 5,280,834, issued on Jan. 25, 1994, to Berkley teaches a storage container that includes a base housing having first and second containers mounted to the housing. The base housing includes a cavity therein, having a rotatable dial projecting through a first side wall of the housing. The dial includes sequential digits visible through a window in a top wall of the housing, wherein sequential days are counted relative to the age of contact lenses, and particularly disposable contact lenses, stored within the first and second containers.

A second example, U.S. Pat. No. 5,452,792, issued on Sep. 26, 1995, to Zautke, et al. teaches a contact lens case that includes a pair of container caps with a timing mechanism for indicating when to perform a certain activity. These time-keeping container caps comprise a cover and flange, one of which is rotatable to reference calendar days, month names or other time-related indicia.

A third example, U.S. Pat. No. 6,038,997, issued on Mar. 21, 2000, to Madden teaches an apparatus for tallying the length of time for which a pair of disposable contact lenses have been worn. A contact lens case is retained by a resilient member against a support member. A counter-defining indicia corresponding to intervals of time is coupled for rotation to the support member. The indicia can be selectively aligned with a reference mark defined by the support member, thereby displaying the amount of time for which a particular pair of contact lenses have been worn.

A fourth example, U.S. Pat. No. 6,382,409, issued on May 7, 2002, to Scala teaches a contact lens case for tracking time of use for both a left and right contact lens. The case includes a base having a top side; a left side cup and right side cup positioned on the top side of the base each receiving a respective one of the left and right contact lenses; a left side timing mechanism for indicating a month and date related to use of the left contact lens; and a right side timing mechanism for indicating a month and date related to use of the right contact lens. The left and right side timing mechanisms may each include a digital display indicating a month and date related to use of the left and right contact lenses, respectively. Alternatively, the left and right timing mechanisms may each include a month and date wheel rotatably secured to the base for providing a month and date related to a respective contact lens. The rotatable month and date wheels of the left and right timing mechanisms each include a locking mechanism for preventing unwanted rotation of the wheels. The left and right side cups each include a side wall extending from the base to form a pool and a cover for selectively restricting access to the pool formed by the side wall. The cover of the left and right side cups each include indicia indicating which contact lens is retained by the cup.

A fifth example, U.S. Patent Office Document No. 20050258053 A1, published on Nov. 24, 2005, to Sieg teaches a compact contact lens case with a base having a top side, a top member with a right opening that receives a right receptacle for receiving a right contact lens, and with a left opening for receiving a left receptacle for receiving a left contact lens and positioned on the top side of the base, a right side receptacle for receiving a right contact lens, a left side receptacle for receiving a left contact lens, a cover for the right side receptacle for receiving a contact lens, a cover for the left side receptacle for receiving a contact lens, and a date wheel for indicating a date related to use of the contact lenses that is manually adjustable independently of a month wheel for indicating a date related to use of the contact lenses. The month wheel is manually adjustable independently of the setting of the date wheel.

A sixth example, U.S. Pat. No. D512,565, issued on Dec. 13, 2005, to Sasso teaches an ornamental design for a contact lens holder having rotating caps with viewing lenses and number indicia for tracking days of usage, as shown and described.

It is apparent now that numerous innovations for contact lens case timers have been provided the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

An object of the present invention is to provide a date indicator for use with a contact lens case that avoids the disadvantages of the prior art.

Another object of the present invention is to provide a date indicator for use with a contact lens case that is simple and inexpensive to manufacture.

Still another object of the present invention is to provide a date indicator for use with a contact lens case that is simple to use.

Briefly stated, still yet another object of the present invention is to provide a date indicator for use with a contact lens case having a base and at least one lens container. The indicator comprises a lid to selectively close the at least one contact lens container. A generally annular day wheel has a clutch means that includes a plurality of day indicators on an upper surface thereof, and is rotatably captured within a cylindrical depression of the lid. A generally circular month wheel includes a plurality of month indicators on an upper surface thereof, and is rotatably captured on a central spindle of the lid. A torsion spring is fixed to a spring mounting mechanism of the day wheel. One end of the spring engages a sawtooth-notched wall of the month wheel and the other end of the spring engages a sawtooth-notched wall of the lid. The spring allows the day and month wheels to rotate in one direction together while preventing the day wheel from rotating in the opposite direction. The day wheel may be set at a desired day indicator by rotating the month wheel and day wheel together in the one direction. The month wheel may be set at a desired month indicator by rotating the month wheel in the opposite direction.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWINGS

The Figures of the drawings are briefly described as follows.

DETAILED DESCRIPTION OF THE PREFERRED EMBODIMENT

Figure 1:
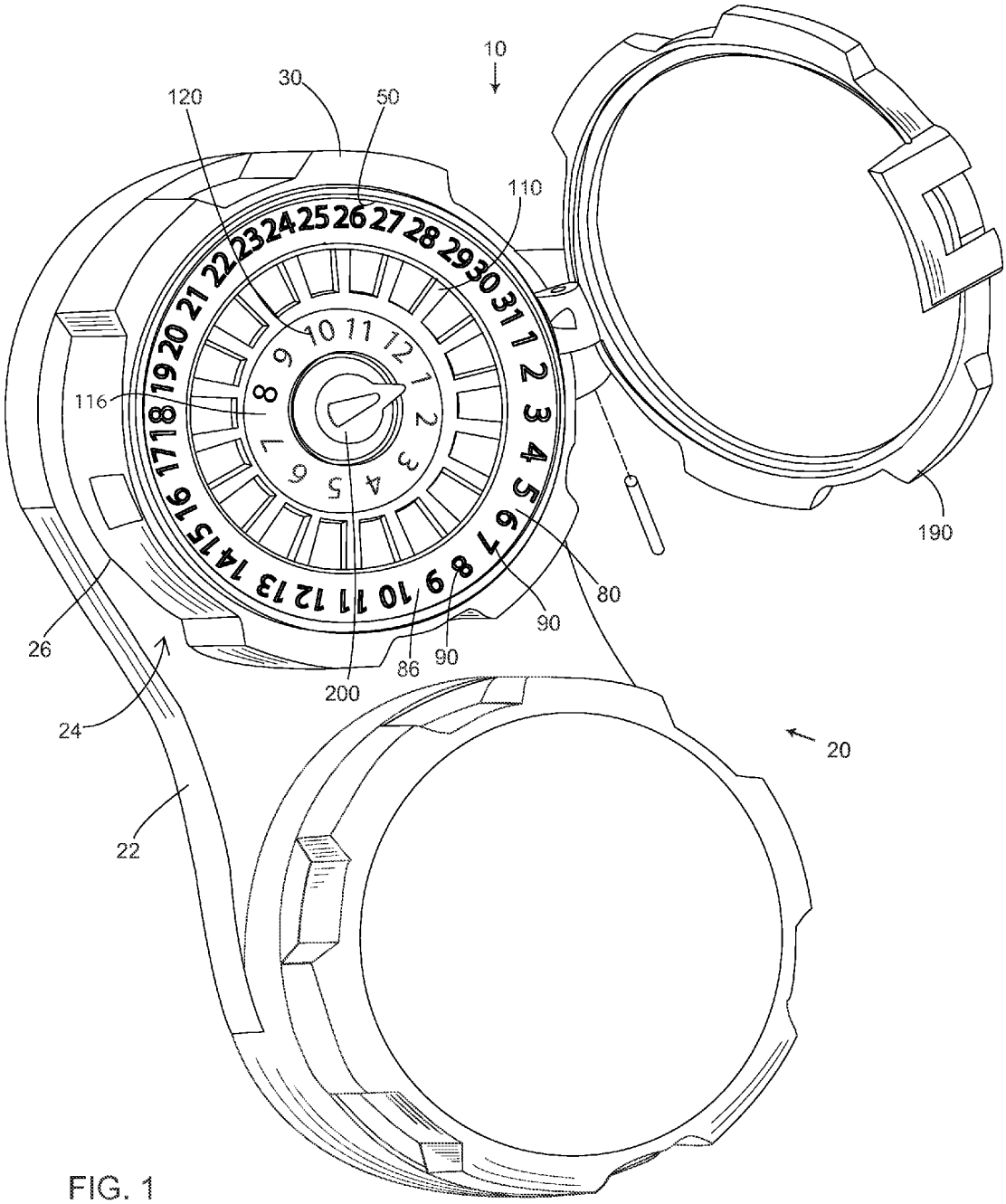
FIG. 1 is a top perspective view of an embodiment of the present invention installed on a contact lens case.
Figure 2:
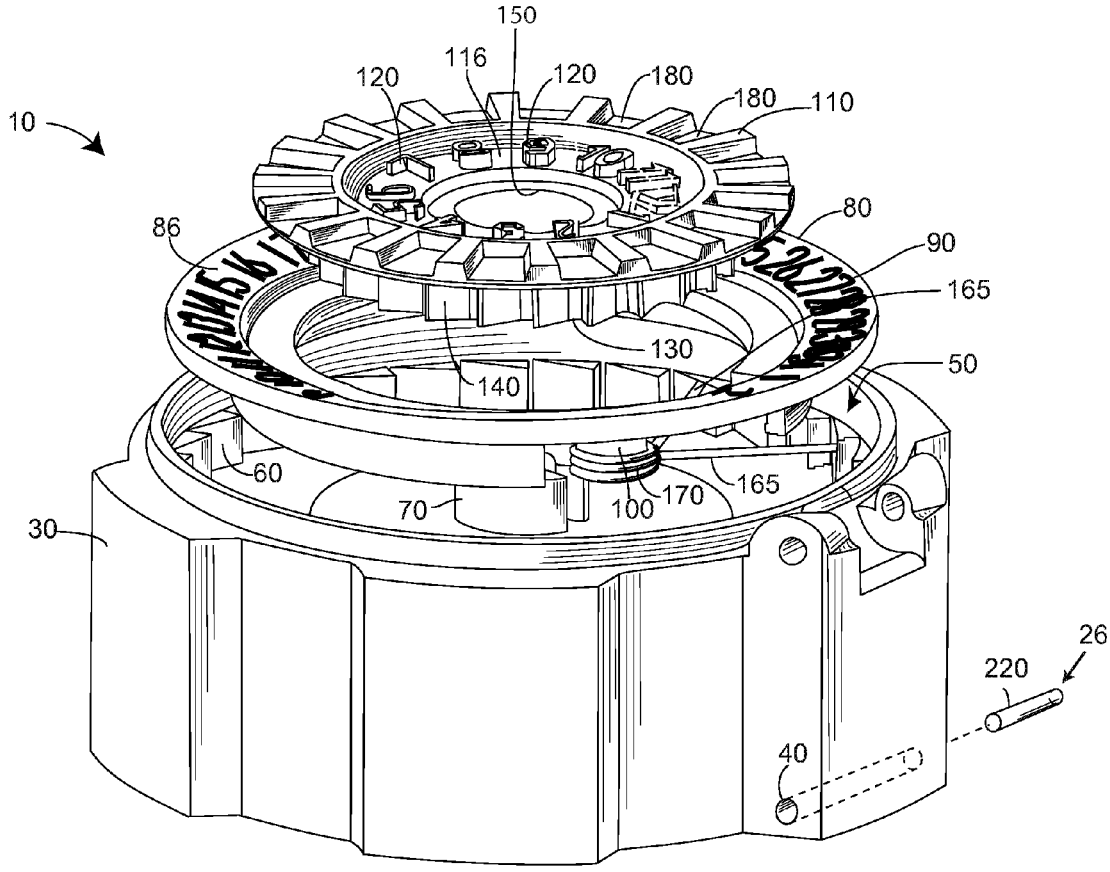
FIG. 2 is a top exploded perspective view of the present invention with parts removed therefrom.
Figure 3:
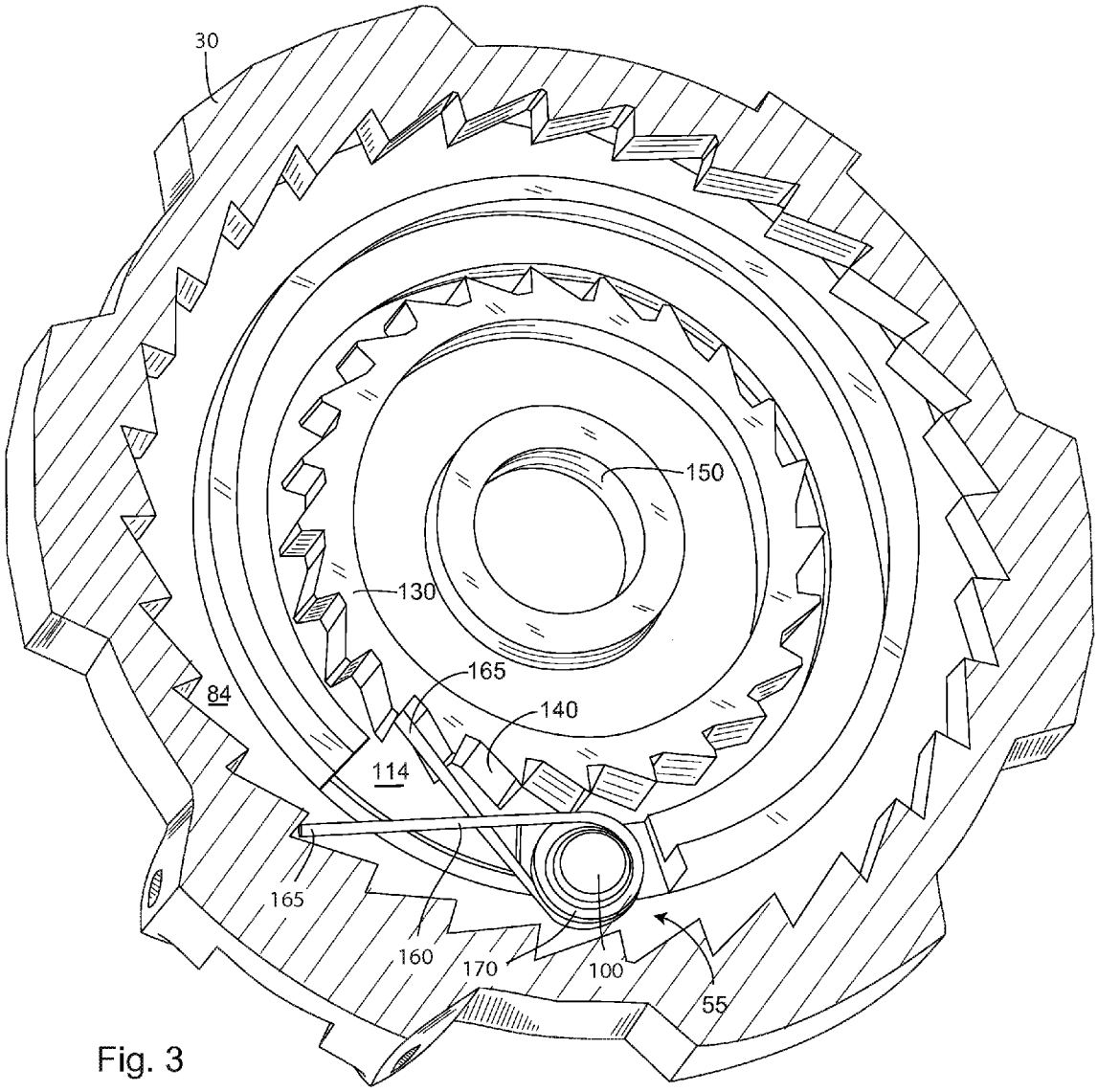
FIG. 3 is a bottom perspective view of the present invention partly in cross section with parts removed therefrom.

Referring now to the figures, in which like numerals indicate like parts, and particularly to FIGS. 1 through 3, the present invention will be discussed with reference thereto. A date indicator 10 is provided for use with a contact lens case 20 having a base 22, at least one lens container 24, and at least one lid attachment mechanism 26. The indicator 10 comprises a lid 30 having a base attachment mechanism 40 cooperative with the lid attachment mechanism 26 of the base 22 to selectively close the at least one contact lens container 24. The lid 30 further includes a generally cylindrical depression 50 therein with a central spindle 70.

A generally annular day wheel 80 has a plurality of day indicators 90 on an upper surface 86 thereof and is rotatably captured within the cylindrical depression 50 of the lid 30. A generally circular month wheel 110 includes a plurality of month indicators 120 on an upper surface 116 thereof and a central aperture 150 rotatably captured on the central spindle 70 of the lid 30. Preferably the lid 30, day wheel 80, and month wheel 110 are each made of a rigid molded plastic material, but could also be formed of metal or other suitable rigid materials.

A clutch means 55 adapted for allowing the day and month wheels 80,110 to rotate in one direction together while preventing the day wheel 80 from rotating in the opposite direction. The clutch means 55 preferably includes a sawtooth-notched wall 60 in the lid 30, a spring mounting means 100 on a lower side 84 of the day wheel 80, a downwardly-extending generally cylindrical projection 130 on a lower side 114 of the month wheel 110 that has a sawtooth-notched wall 140, and a torsion spring 160 comprising at least two laterally-separated ends 165 and a wheel attachment means 170 fixed to the spring mounting means 100 of the day wheel 80. As such, one end 165 of the spring 160 engages the sawtooth-notched wall 140 of the month wheel 110 and the other end 165 of the spring 160 engages the sawtooth-notched wall 60 of the lid 30, thereby allowing the day and month wheels 80,110 to rotate in one direction together while preventing the day wheel 80 from rotating in the opposite direction. The day wheel 80 may be set at a desired day indicator 90 by rotating the month wheel 110 and day wheel 80 together in the one direction. The month wheel 110 may then be set at a desired month indicator 120 by rotating the month wheel 110 in the opposite direction.

An alternate clutch means 55 may be included wherein the torsion spring 160 and sprint mounting means 100 are built into day wheel 80, for example (not shown), wherein just the two ends 165 of the spring 160 protrude from the lower side 84 of the day wheel 80 to engage the sawtooth-notched walls 60,140. The clutch means 55 may alternately include other one-way clutch means between each wheel 80,110 and between the day wheel 80 and the lid 30 (not shown).

The torsion spring 160 is preferably a resilient wire and the wheel attachment mechanism 170 is a looped section thereof, but could also be made in the form of a plastic clip (not shown), or formed integrally with the day wheel 80 (not shown). The day wheel 80 may rotate only clockwise, for example, while the month wheel 110 may rotate only counterclockwise. The month wheel 110 further preferably includes at least one depression 180 in the upper surface 116 thereof, whereby the day and month wheels 80, 110 may be rotated by inserting a pointed implement (not shown) into the depression 180 and rotating the wheels 80,110 thereby.

The lid 30 may further include a cap 190 pivotally attached to the lid 30, whereby the wheels 80, 110 may be selectively covered by the cap 190. The date indicator 10 further may include a spindle cap 200 fixed to the spindle 70 that captures the month wheel 110 in the spindle 70. The month wheel 110 rotatably captures the day wheel 80 on the spindle 70. The lid attachment mechanism 26 may be a pivot pin 220 captured by both the base 22 and the lid 30. The lid attachment mechanism 26 may also be a screw thread (not shown).

It will be understood that each of the elements described above, or two or more together, may also find a useful application in other types of constructions differing from the type described above. While the invention has been illustrated and described as embodiments of a date indicator for use with a contact lens case, accordingly it is not limited to the details shown, since it will be understood that various omissions, modifications, substitutions and changes in the forms and details of the device illustrated and its operation can be made by those skilled in the art without departing in any way from the spirit of the present invention. For example, the day indicators 90 may be placed on the month wheel 110 and the month indicators 120 may be placed on the day wheel 80, effectively swapping the wheels 80,110, without changing the spirit or scope of the invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A date indicator for use with a contact lens case having a base, at least one lens container, and at least one lid attachment means, the indicator comprising:

a lid having a base attachment means cooperative with the lid attachment means of the base to selectively close the at least one contact lens container, the lid further having a central spindle projecting substantially upwardly and orthogonally therefrom;

a generally annular day wheel having a plurality of day indicators on an upper surface thereof and being rotatably captured within the lid;

a generally circular month wheel including a plurality of month indicators on an upper surface thereof and having a central aperture rotatably captured within the lid; and a clutch means adapted for allowing the day and month wheels to rotate in one direction together while preventing the day wheel from rotating in an opposite direction, the clutch means comprising:

a generally cylindrical depression in the lid that has a sawtooth-notched wall;

a spring mounting means on a lower side of the day wheel;

a downwardly-extending generally cylindrical projection on a lower side of the month wheel having a sawtooth-notched wall; and a torsion spring comprising at least two laterally separated ends and a wheel attachment means fixed to the spring mounting means of the day wheel, such that one end of the spring engages the sawtooth-notched wall of the month wheel and the other end of the spring engages the sawtooth-notched wall of the lid;

whereby the spring allows the day and month wheels to rotate in the one direction together while preventing the day wheel from rotating in the opposite direction;

whereby the day wheel may be set at a desired day indicator by rotating the month wheel and day wheel together in the one direction, and the month wheel may be set at a desired month indicator by rotating the month wheel in the opposite direction.

2. The date indicator of claim 1 wherein the torsion spring is a resilient wire and the wheel attachment means is a looped section thereof.

3. The date indicator of claim 1 wherein the month wheel further includes at least one depression in the upper surface thereof, whereby the day and month wheels may be rotated by inserting a pointed implement into the depression and rotating the wheels thereby.

4. The date indicator of claim 1 wherein the lid further includes a cap pivotally attached to the lid, whereby the wheels may be selectively covered by the cap.

5. The date indicator of claim 1 wherein the lid further includes a cap pivotally attached to the lid, whereby the wheels may be selectively covered by the cap.

6. The date indicator of claim 1 wherein the month wheel rotatably captures the day wheel on the spindle.

7. The date indicator of claim 1 wherein the plurality of day indicators are included on the month wheel and the month indicators are included on the day wheel, effectively swapping the wheels, whereby the day wheel may be set at a desired month indicator by rotating the month wheel and the day wheel together in the one direction, and the month wheel may be set at a desired day indicator by rotating the month wheel in the opposite direction.

8. A date indicator for use with a contact lens case having a base, at least one lens container, and at least one lid attachment means, the indicator comprising:

a base having at least one lens container and at least one lid attachment means;

a lid having a base attachment means cooperative with the lid attachment means of the base to selectively close the at least one contact lens container, the lid further having a central spindle projecting substantially upwardly and orthogonally therefrom;

a generally annular day wheel having a plurality of day indicators on an upper surface thereof and being rotatably captured on the central spindle of the lid;

a generally circular month wheel including a plurality of month indicators on an upper surface thereof and having a central aperture rotatably captured on the central spindle of the lid; and a clutch means adapted for allowing the day and month wheels to rotate in one direction together while preventing the day wheel from rotating in an opposite direction, the clutch means comprising:

a generally cylindrical depression in the lid that has a sawtooth-notched wall;

a spring mounting means on a lower side of the day wheel;

a downwardly-extending generally cylindrical projection on a lower side of the month wheel having a sawtooth-notched wall; and a torsion spring comprising at least two laterally separated ends and a wheel attachment means fixed to the spring mounting means of the day wheel, such that one end of the spring engages the sawtooth-notched wall of the month wheel and the other end of the spring engages the sawtooth-notched wall of the lid;

whereby the spring allows the day and month wheels to rotate in the one direction together while preventing the day wheel from rotating in the opposite direction;

whereby the day wheel may be set at a desired day indicator by rotating the month wheel and day wheel together in the one direction, and the month wheel may be set at a desired month indicator by rotating the month wheel in the opposite direction.

9. The date indicator of claim 8 wherein the torsion spring is a resilient wire and the wheel attachment means is a looped section thereof.

10. The date indicator of claim 8 wherein the month wheel further includes at least one depression in the upper surface thereof, whereby the day and month wheels may be rotated by inserting a pointed implement into the depression and rotating the wheels thereby.

11. The date indicator of claim 8 wherein the lid further includes a cap pivotally attached to the lid, whereby the wheels may be selectively covered by the cap.

12. The date indicator of claim 8 further including a spindle cap fixed to the spindle and rotatably capturing the month wheel on the spindle.

13. The date indicator of claim 8 wherein the month wheel rotatably captures the day wheel on the spindle.

14. The date indicator of claim 8 wherein the lid attachment means is a screw thread.

15. The date indicator of claim 8 wherein the lid attachment means is a pivot pin captured by both the base and lid.

16. The date indicator of claim 8 wherein the plurality of day indicators are included on the month wheel and the month indicators are included on the day wheel, effectively swapping the wheels, whereby the day wheel may be set at a desired month indicator by rotating the month wheel and the day wheel together in the one direction, and the month wheel may be set at a desired day indicator by rotating the month wheel in the opposite direction.

* * * * *